United States Patent [19]

Ligon

[11] 4,270,757

[45] Jun. 2, 1981

[54] TETHERED BALL GAME AND APPARATUS

[75] Inventor: Samuel B. Ligon, Dallas, Tex.

[73] Assignee: Jokari/U.S., Inc., Dallas, Tex.

[21] Appl. No.: 26,284

[22] Filed: Apr. 2, 1979

[51] Int. Cl.[3] ..... A63B 67/00

[52] U.S. Cl. ..... 273/411; 273/413

[58] Field of Search ..... 273/26 E, 29 A, 58 C, 273/95 G, 95 H, 95 A, 411, 413, 321

[56] References Cited

U.S. PATENT DOCUMENTS

| | | | |
|---|---|---|---|
| 660,787 | 10/1900 | Bissell | 273/58 C |
| 1,608,849 | 11/1926 | Gilmour | 273/95 A |
| 2,243,620 | 5/1941 | Del Llano Y Fernandez | 273/95 A |
| 2,282,766 | 5/1942 | Miremont | 273/58 C |
| 2,747,873 | 5/1956 | Carroad | 273/95 A |
| 3,297,321 | 1/1967 | Kuhnes et al. | 273/26 R |
| 3,804,409 | 4/1974 | Schnachner | 273/95 A |
| 3,985,359 | 10/1976 | Moore | 273/95 H |
| 4,162,790 | 7/1979 | Kelsey | 273/58 C |

FOREIGN PATENT DOCUMENTS

| | | | |
|---|---|---|---|
| 1162827 | 9/1958 | France | 273/95 A |
| 838470 | 6/1960 | United Kingdom | 273/95 A |

OTHER PUBLICATIONS

"Sporting Goods Dealer", Feb. 1979.

*Primary Examiner*—Peter Chin

*Attorney, Agent, or Firm*—Richards, Harris & Medlock

[57] ABSTRACT

The specification discloses an apparatus and method for playing a game (10) on a playing surface with a tethered ball (28) and stringed racquets. The ball (28) is connected to one end of a resilient tether cord (24), which is anchored at the other end to the playing surface. A boundary line (54) of predetermined length is positioned on the playing surface in spaced apart relationship with the anchor point of the tether cord (24). The boundary line (54) divides the playing surface into a playing zone (56) wherein the players must remain during the game, and a bounce zone (58). The ball (28) must be struck by the players such that it crosses over the boundary line (54) and bounces initially in the bounce zone (58).

12 Claims, 9 Drawing Figures

TETHERED BALL GAME AND APPARATUS

TECHNICAL FIELD

The present invention relates in general to a ball game. More particularly, this invention concerns a novel apparatus and method for playing a game with a tethered ball.

BACKGROUND ART

The game of racquetball is gaining in popularity. The game is played by two or more participants in a large room defining an enclosed court which is generally 20 feet wide, 40 feet long and 20 feet high. The floor, ceiling and all four walls of the court are used as a free racquetball is hit around the court by players holding stringed rackets. The game is relatively safe, but injuries can occur from collisions with the walls or other players, or from being struck by the ball or another player's racquet. The game involves quickness, reflexes, coordination and strategy.

Although the equipment for playing racquetball is relatively inexpensive and easily acquired, the facilities for the game are not. A racquet, ball and appropriate clothing are all that is necessary in the way of equipment. These items are now offered in many sporting goods stores and department stores. Suitable racquetball courts, however, are not so readily available. These facilities are expensive, must be specially constructed and are usually found only in gymnasiums, fitness centers, health clubs and the like. Membership fees are generally charged for the privilege of using these facilities.

Availability of suitable facilities has thus prevented many people from enjoying the game of racquetball.

There is thus a need for a new ball game approximating racquetball but not requiring a closed court for play. Several types of games using a ball constrained by a tether line have been heretofore developed. Paddles, bats, clubs or other devices have been used in these games to strike the ball. None of these prior games, however, lend themselves to use in simulating the game of racquetball, as the feel and sound of the ball is different, and the prior games do not simulate the enclosed racquetball court.

DISCLOSURE OF INVENTION

The present invention comprises a tethered ball game which overcomes the foregoing and other difficulties associated with the prior art. In accordance with the invention, there is provided a game adapted to be played on a hard surface, indoors or outdoors. The game includes a resilient tether cord anchored at one end to the playing surface. A hollow ball is connected to the other end of the tether cord. A boundary line is positioned on the playing surface a predetermined distance from the anchor point of the tether cord. The fixed boundary line and movable ball define the court in which the game is played. One side of the boundary line comprises a playing zone. Players located in the playing zone hit the ball across the boundary line to simulate the strokes and ball rebound of an enclosed racquetball court without the four sidewalls or ceiling required in a conventional racquetball court.

More particularly, the present invention comprises a game with a tethered ball adapted to be struck by stringed racquets. The gameball is pressureless and hollow, and is constructed to simulate the feel, bounce and sound of a conventional racquetball. The wall of the ball includes at least one inwardly tapered aperture therein. A loop extends through the aperture and forms a yoke connected to the ball.

The ball is connected by the yoke to one end of an elastic tether cord, which is preferably about 12 feet long when relaxed. The other end of the tether cord is attached to a base. In accordance with the preferred construction, the base comprises a portable anchor block which is sufficiently weighty to remain stationary during the game.

A boundary line of predetermined length is positioned on the playing surface a predetermined distance from the base. The boundary line is preferably about 20 feet long and spaced from the base a distance of about 12 feet, or substantially equal to the length of the tether cord when relaxed. That side of the boundary line on which the base is located comprises a playing zone within which the players can move. The front end and sides of the playing zone are defined by the boundary line and ends thereof, respectively. The other side of the boundary line comprises a bounce zone. A front wall such as that in an enclosed racquetball court is thus simulated by the boundary line and action of the tethered ball.

When the ball is hit across the boundary line, the ball bounces in the bounce zone and rebounds under the action of the tether cord for return by the other player. The object of the game is to score points by proper play of the tethered ball relative to the boundary line and bounce zone. The tether cord, ball and boundary line together with the playing surface define an open court within which simulated racquetball can be played without sidewalls or a ceiling.

BRIEF DESCRIPTION OF DRAWINGS

A more complete understanding of the invention can be had by referring to the following Detailed Description in conjunction with the accompanying Drawings, wherein.

DETAILED DESCRIPTION

Figure 1:
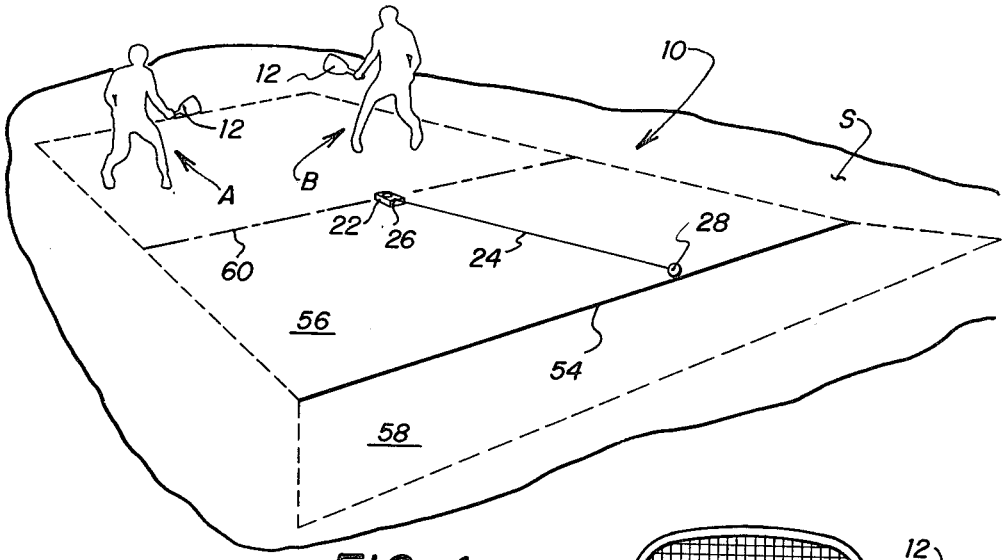
FIG. 1 is a perspective illustration of a tethered ball game incorporating the invention.

Referring now to the Drawings, wherein like reference numerals designate like or corresponding parts throughout the several views, and particularly referring to FIG. 1, there is shown a tethered ball game 10 incorporating the invention. The game 10 is played on a flat, relatively hard surface S of at least 20 feet width and 30 feet length. Surface S can be located either indoors or outdoors. For example, surface S can comprise a gymnasium floor, driveway, parking lot, street or the like.

As will be more fully described hereinafter, simulated racquetball can be played with game 10 on surface S without requiring a ceiling or four sidewalls, which have traditionally been necessary to define a racquetball court. Simulated racquetball is played with a ball tethered at the end of a resilient cord of about 12 feet length and a boundary line of about 20 feet length, which simulates the front wall in an enclosed racquetball court, located on surface S about 12 feet from the anchored end of the tether cord.

Game 10 is played by one or more players. For purposes of illustration, two players A and B are shown playing game 10 in FIG. 1. Players A and B can be male or female, youth or adult. Each player A and B holds a stringed racquet 12 which is used in playing game 10. An opposed to paddles, bats or clubs, the tethered ball game 10 is played with stringed racquets 12.

Figure 2:
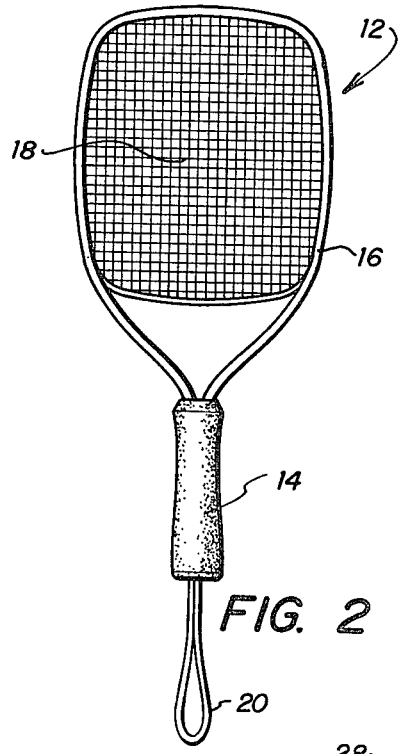
FIG. 2 is a side view of a stringed racquet useful in playing the game of the invention.

Referring to FIG. 2, the construction of a typical racquet 12 can be seen. Racquets 12 are of substantially conventional construction, and may be of the type which are used in playing conventional racquetball. Each racquet 12 includes a handle 14 supporting an open frame 16 across which a plurality of strings 18 are strung in mutually spaced apart, criss-cross fashion under tension. Each player grips a racquet 12 by handle 14. Preferably, each racquet 12 includes a safety loop 20 through which the handle 14 is grasped. In the event a player A or B loses his grip on handle 14, safety loop 20 prevents the racquet from flying away and thus causing damage or injury. It will thus be understood that the use of stringed racquets 12, although substantially conventional in construction, comprises a feature of the game 10 herein.

Referring again to FIGS. 1 and 3, game 10 includes a base 22 for anchoring one end of a tether cord 24 to the surface S. In accordance with the preferred construction of game 10, base 22 comprises a portable anchor block having non-slip material on the bottom surface thereof. Base 22 is sufficiently heavy to remain stationary during play of game 10, but is not so heavy as to prevent portability of the game.

Figure 3:
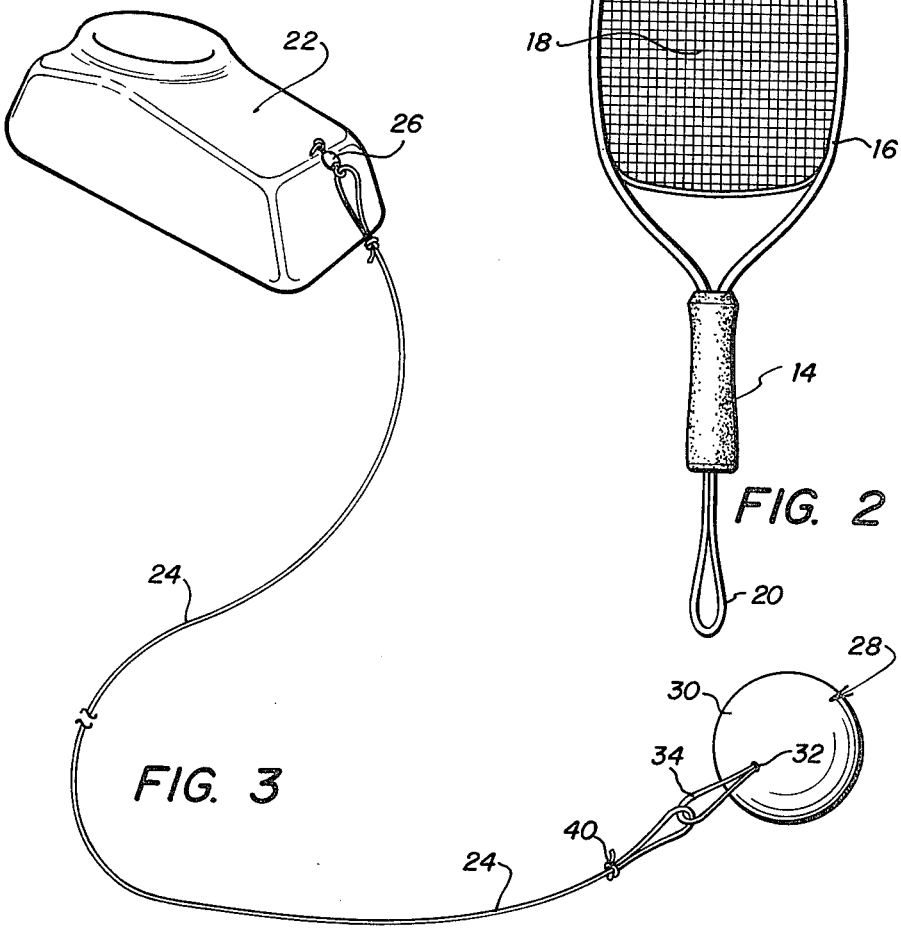
FIG. 3 is an enlarged view of a ball, tether cord and anchor block which are used in the game of the invention.

A tethered ball is secured to base 22. Tether cord 24 is preferably connected to base 22 with a swivel connection 26, which is best shown in FIG. 3. The tether cord 24 is of predetermined length and is formed of elastic material. In accordance with the preferred construction of game 10, tether cord 24 is about twelve feet long when relaxed and up to twenty-four feet long when stretched, and comprises elastomeric material having a protective outer cover of plastic material. A ball 28 is connected at the other end of tether cord 24, and is thus tethered to base 22. Movement of ball 28 is constrained by the length and elasticity of tether cord 24.

The tethered ball 28 is hollow, pressureless, and has predetermined bounce characteristics. Ball 28 is constructed to simulate the feel, sound and bounce of a conventional racquetball. Ball 28 is preferably constructed like the balls shown in patent application Ser. No. 1,742 filed Jan. 8, 1979, entitled TETHERABLE GAME BALL and assigned to the assignee hereof. Two ball constructions are shown in FIGS. 3–6. Other suitable constructions for ball 28 can be used, if desired.

Figure 4:
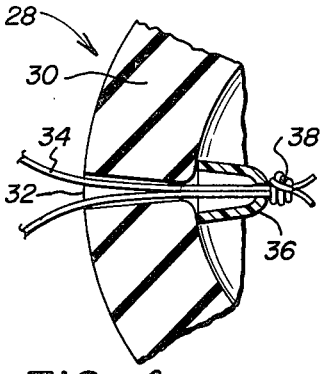
FIG. 4 is an enlarged, partial sectional view of the ball shown in FIG. 3.

The constructional details of ball 28 are shown in FIGS. 3 and 4. Ball 28 comprises a hollow, spherical body having a single aperture 32 therein. Preferably, the aperture 32 is circular in cross-section and radially tapered in an inward direction as is best shown in FIG. 4. The inside end of aperture 32 is preferably beveled at the interior surface of body 30. The spherical body 30 is preferably comprised of rubber or cross-linked synthetic rubber compound. The diameter of body 30 is about 2.25 inches.

Ball 28 is connected to tether cord 24 by means of a yoke 34 extending through the aperture 32 in body 30. Yoke 34 comprises a loop formed from the length of flexible but substantially inextensible line. Yoke 34 is preferably formed from nylon line. The ends of the line forming yoke 34 extend through aperture 32 and plug 36, and are secured together in a knot 38. Plug 36 prevents yoke 34 from being pulled out of ball 28, and helps distribute the forces transmitted by the yoke from tether cord 24 into body 30. Plug 36 is preferably wedge-shaped or cone-shaped, and includes a flat base in engagement with the interior surface of body 30. Plug 36 can be constructed of plastic or other suitable semi-rigid or rigid material. The end of tether cord 24 extends through yoke 34 and is secured by a knot 40. It has been found that a sailor's knot resists loosening and works well for knots 38 and 40.

Figure 5:
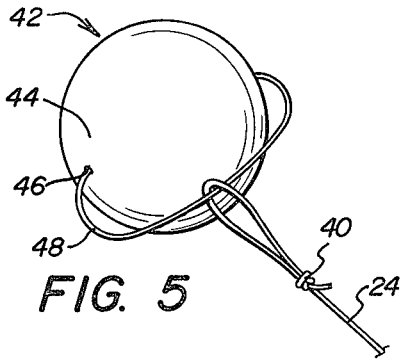
FIG. 5 is a side view of another ball which can be used in the game of the invention.
Figure 6:
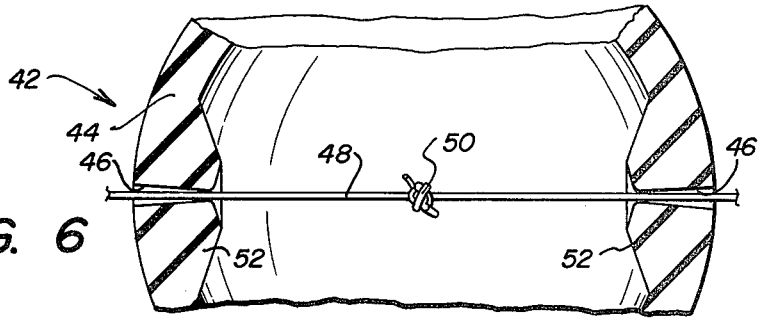
FIG. 6 is an enlarged, partial sectional view of the ball shown in FIG. 5.

FIGS. 5 and 6 show another ball which can be used in game 10 as an alternative to ball 28. Ball 42 is also hollow, pressureless and constructed to simulate the feel, sound and bounce of a conventional racquetball. Ball 42 comprises a substantially spherical body 44 having two diametrically opposed apertures 46 therein. Body 44 is preferably constructed of rubber or cross-linked synthetic rubber compound. The diameter of body 44 is approximately 2.25 inches.

A yoke 48 extends through the apertures 46 in body 44. Preferably, each aperture 46 is substantially circular in cross-section and radially tapered in an inward direction, as is best illustrated in FIG. 6. Preferably, the inside ends of apertures 46 are beveled at the interior surface of body 44. Yoke 48 comprises a length of flexible but substantially inextensible line formed into a loop. Preferably, yoke 48 is constructed from nylon line. The line comprising yoke 48 is threaded through apertures 46, and the ends of the line are secured together by a knot 50 positioned inside ball 42. Yoke 48 is connected to tether cord 24 in a manner similar to that described with regard to ball 28, but transfers forces from the tether cord to the ball in two areas. For reinforcement, raised bosses 52 are integrally formed on the interior surface of body 44 around apertures 46.

The balls shown in FIGS. 3–6 are pressureless to enable connection to the cord 24, but they are constructed and dimensioned to provide a bounce and feel substantially equivalent to a conventional racquetball.

Referring again to FIG. 1, the tethered ball game 10 further includes a line 54 defining a boundary on surface S. Boundary line 54 is of predetermined length, and is positioned a predetermined distance away from base 22 and centrally with respect thereto. In accordance with the preferred embodiment of game 10, line 54 comprises a vinyl cord of twenty feet length positioned about twelve feet, or about the relaxed length of tether cord 24, from base 22. Line 54 is preferably brightly colored for visibility.

It will be understood that the use of line 54 comprises a significant feature of the present invention. The relationship between line 54, base 22, tether cord 24 and ball 28 defines a playing zone 56 and a bounce zone 58 on surface S within which simulated racquetball can be played with game 10 but without requiring conventional racquetball court walls and ceiling.

Playing zone 56, which is outlined with dashed lines in FIG. 1, is generally rectangular and lies on one side of line 54. Base 22 of game 10 is positioned near the center of playing zone 56. A twenty foot boundary line 54 and a twelve foot tether cord 24 serve to define a playing zone 56 of about twenty feet width by thirty feet length.

Playing zone 56 thus simulates a court having fixed front and side boundaries, but a variable back boundary dependent upon the manner in which ball 28 recoils on tether cord 24. Boundary line 54 defines the width and frontmost limit of playing zone 56.

On the other side of boundary line 54, the bounce zone 58 is generally trapezoidal as indicated by dashed lines in FIG. 1. It will be understood that only one side of bounce zone 58 is defined by boundary line 54, while the remaining periphery of the bounce zone varies in accordance with the manner in which ball 28 is struck relative to the boundary line by the players. The exact outline of bounce zone 58 is thus variable as line 54 is the only fixed portion thereof.

It will thus be apparent that boundary line 54 functions to simulate the front wall of a conventional enclosed racquetball court, and sets the side boundaries of playing zone 56. When ball 28 is hit across line 54, tether cord 24 stretches until forward motion of the ball is arrested, after which the ball is recoiled by the tether cord in a manner simulating rebound of a free racquetball off the front wall in an enclosed court. Ball 28 is returned by tether cord 24 as if it were a free racquetball rebounding off the front wall in an enclosed conventional court. This relationship between tether cord 24, ball 28 and boundary line 54 enables a close approximation of racquetball to be played with game 10 without requiring an enclosed court.

Having described the apparatus of game 10, the method of playing the game will now be explained while referring to FIG. 1 and FIGS. 7–9. In playing game 10, some of the techniques of conventional racquetball are utilized. The game of racquetball, however, is played with reference to a front wall using three other sidewalls and the ceiling. In conventional racquetball, a free ball is rebounded off the floor, ceiling and side walls. In contrast, game 10 is played with reference to boundary line 54 and a tethered ball 28 is bounced on surface S and rebounded by tether cord 24 only. Simulated racquetball without sidewalls or a ceiling can thus be played with game 10.

The players must remain on one side of boundary line 54 at all times. That is, the players must remain in playing zone 56 and should not cross line 54 into bounce zone 58 at any time. The players are thus free to move in front of or behind base 22 of game 10. This is in contrast to previously developed tether ball games wherein the players are limited to one side of the base, and the ball is not played with respect to any particular boundary line.

A serve begins the game. The player serving ball 28 must stand adjacent to base 22 and on or near an imaginary line 60 extending across playing zone 56. Imaginary service line 60, which is shown in FIG. 1, extends parallel to boundary line 54 and through base 22.

The serve is made by manually bouncing ball 28 on surface S and then striking it with a racquet 12. The serve must cross boundary line 54, bounce initially in bounce zone 58, and return across imaginary service line 60 before the next bounce therebehind. The crossing by ball 28 over the boundary line 54 provides side boundaries to the court without the requirement of side walls. The length of cord 24 is chosen to be 12 feet in its relaxed state so as to simulate a bounce from a side or end wall, such that the return ball is very similar in bounce and speed to a ball actually hit against a conventional racquetball court wall. It will be apparent that hitting ball 28 across line 54 causes cord 24 to stretch until forward movement of the ball is arrested, after which the ball is returned under the action of the tether cord. Moreover, the ball 28 bounces, feels and sounds like a conventional racquetball. The present game can thus be used as an excellent training or practice game or conventional racquetball.

The player serving is allowed one fault. If there are two consecutive faults, the service changes to the other player. A serving fault may occur when ball 28 does not cross line 54 an bounce initially in the bounce zone 58, or if the ball does not bounce behind imaginary service line 60 upon the next bounce. After the serve, the serving player can move to any position within playing zone 56.

Figure 7:
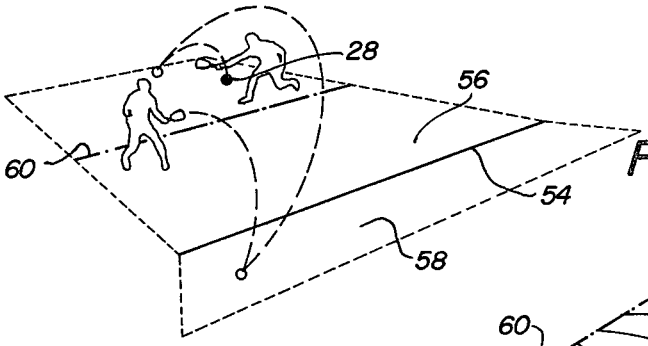
FIGS. 7–9 are perspective, diagrammatic illustrations showing the method of playing the game of the invention.

The receiving player must stand behind imaginary service line 60 for the return. The receiving player can hit ball 28 on the fly, or let the ball bounce once in playing zone 56 before returning it across boundary line 54. The ball 28 must cross boundary line 54 and bounce first in bounce zone 58 after each return strike to remain in play. FIG. 7 illustrates a good serve and return. After returning the serve, the player can move to any position within playing zone 56.

Figure 8:
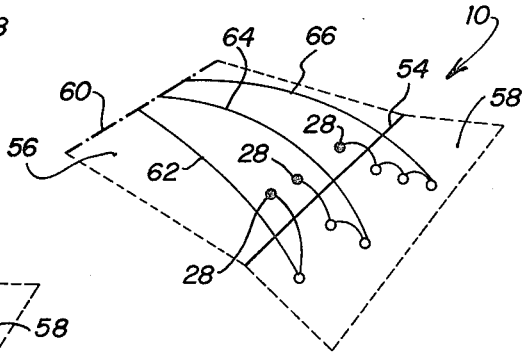
Figure 9:
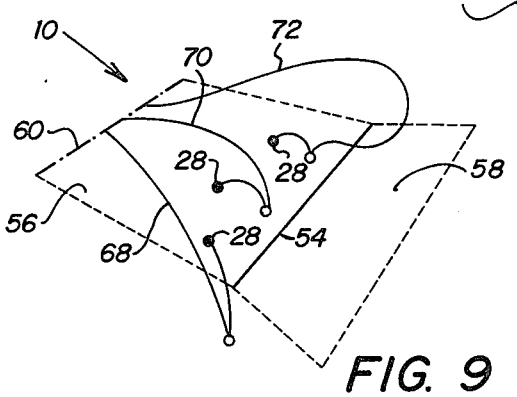

To remain in play, ball 28 must cross boundary line 54 after each shot and bounce at least the first time in bounce zone 58. FIGS. 8 and 9 illustrate good and bad shots, respectively, in playing game 10. Shots 62, 64 and 66 in FIG. 8 illustrate good shots because each ball crosses boundary line 54 and bounces at least once in the bounce zone 58. Shots 68, 70 and 72 in FIG. 9 depict bad shots because the balls either do not hit in zone 58 on the first bounce or they do not cross boundary line 54 before the first bounce.

Shots 64, 66 and 72 in particular demonstrate the closeness with which game 10 simulates conventional racquetball. It will be observed that a shot that bounces twice in bounce zone 58, like shots 64 and 66, after crossing boundary line 54 cannot be returned by the other player, much like a kill shot or "roll out" in conventional racquetball. A shot too high, like shot 72, will not bounce first in bounce zone 58, much like an extremely high shot in conventional racquetball will not hit the front wall and thus result in a lost point. Points are scored in game 10 with low shots just like they are scored when playing conventional racquetball in an enclosed court.

It will thus be apparent that the outer boundary of bounce zone 58 is determined by the manner in which ball 28 is struck across boundary line 54. A ball struck from a forward position to the side of playing zone 56 would cross boundary line 54 at a shallow angle and bounce therebehind at a point considerably outward from the end of the boundary line, thereby making the bounce zone shallow and relatively wide at the back end. The effective depth of bounce zone 58 depends upon the power used when striking ball 28 and the crossing angle between the ball and the boundary line 60.

Points or service turnovers are scored when a player fails to keep ball 28 in play. Only the player serving the ball can score points. The serving player scores a point when the other player makes a bad shot or error, such as that described with regard to FIG. 9. The serving player can also score a point when the other player becomes entangled in tether cord 24. The receiving player gains the right to serve when the serving player commits a double fault or commits an error. The receiving player thus becomes entitled to serve and score points. The winner is the first player reaching a predetermined number of points, such as 21 points.

Some miscellaneous rules with respect to playing game 10 are as follows. If ball 28 hits base 22, the point should be replayed. If ball 28 bounces on boundary line 54, it is a bad shot. The point is replayed if one player unavoidably hinders or interferes with the other player. The point or serve is lost if the hindrance or interference was avoidable. A player becoming entangled with tether cord 24 during play loses that point or serve. If the ball hits the other player before it crosses boundary line 54, the point is lost by the player making that shot. A player struck by the ball after it crosses boundary line 54 loses that point or serve.

From the foregoing, it will be understood that the present invention comprises a novel tethered ball game having numerous advantages over the prior art. The game can be played indoors or outdoors on any suitable surface within an area of about 20×30 feet. A fixed line in conjunction with a ball connected at the end of an elastic tether cord define an open court in which a facsimile of racquetball can be played without the benefit of sidewalls or a ceiling. In combination with the tethered ball, the boundary line simulates the front wall in a conventional enclosed racquetball court and sets the side boundaries of the playing zone. Other advantages will suggest themselves to those skilled in the art.

Although particular embodiments of the invention have been illustrated in the accompanying Drawings and described in the foregoing Detailed Description, it will be understood that the invention is not limited to the embodiments disclosed, but is intended to embrace any alternatives, modifications, and rearrangements and/or substitutions of parts and elements as fall within the spirit and scope of the invention.

I claim:

1. Game apparatus for playing simulated racquetball on an open playing surface by one or more players using racquets, which comprises:

line means positioned on the playing surface for defining a bounce zone and a playing zone separated by a substantially straight boundary line of predetermined length, said boundary line means having a midpoint;

said boundary line means separating the playing zone in which the players move during the game, and the bounce zone on the playing surface;

a base positioned on the playing surface in predetermined spaced apart relationship in a direction substantially normal to the midpoint of said boundary line means, said base being located within the playing zone;

an elastic tether cord of predetermined length in relaxed condition substantially equal to the distance between said base and boundary line means, said tether cord having two ends;

swivel means for rotatably connecting one end of said tether cord to said base;

a resilient ball having a hollow interior and a radial aperture extending between substantially spherical inside and outside surfaces;

an inelastic loop positioned in the aperture of said ball and having inside and outside ends, the outside end of said loop being connected to the other end of said tether cord; and plug means secured to the inside end of said loop within said ball for preventing separation of said loop from said ball;

said ball having bounce characteristics similar to a standard racquetball and being suitable for repeated bouncing and hitting by racquets held by the players;

said ball, tether cord and boundary line means cooperating such that said ball, when struck with a racquet and hit over said boundary line means, bounces in the bounce zone and is returned by said tether cord and caused to bounce in the playing zone in a manner simulating that in which a free racquetball rebounds from the walls of a conventional enclosed racquetball court.

2. The game apparatus of claim 1, wherein said boundary line means comprises a length of flexible line.

3. The game apparatus according to claim 2, wherein said flexible line is about twenty feet long, thereby approximating the width of a standard enclosed racquetball court.

4. The game apparatus of claim 1, wherein said tether cord is about twelve feet long in relaxed condition and comprises elastomeric material.

5. The game apparatus of claim 1, wherein said base is portable but sufficiently weighty to remain stationary during movement of said tether cord and ball upon play.

6. The game apparatus of claim 1, wherein the other end of said tether cord is looped through said loop, turned back and secured to itself.

7. Game apparatus for playing simulated racquetball on an open playing surface by one or more players using racquets, which comprises:

line means positioned on the playing surface for defining a bounce zone and a playing zone separated by a substantially straight boundary line of predetermined length, said boundary line means having a midpoint;

said boundary line means separating the playing zone in which the players move during the game, and the bounce zone on the playing surface;

a base positioned on the playing surface in predetermined spaced apart relationship in a direction substantially normal to the midpoint of said boundary line means, said base being located within the playing zone;

an elastic tether cord of predetermined length in relaxed condition substantially equal to the distance between said base and boundary line means, said tether cord having two ends;

swivel means for rotatably connecting one end of said tether cord to said base;

a resilient ball having a hollow interior and diametrically opposed radial apertures extending between substantially spherical inside and outside surfaces;

the inside surface of said ball having a raised boss integrally formed therein surrounding each aperture for reinforcing the apertures; and an inelastic loop extending through the ball apertures and around said ball, the other end of said tether cord being connected to said loop;

said ball having bounce characteristics similar to a standard racquetball and being suitable for repeated bouncing and hitting by racquets held by the players;

said ball, tether cord and boundary line means cooperating such that said ball, when struck with a racquet and hit over said boundary line means, bounces in the bounce zone and is returned by said tether cord and caused to bounce in the playing zone in a manner simulating that in which a free racquetball rebounds from the walls of a conventional enclosed racquetball court.

8. The game apparatus of claim 7, wherein said boundary line means comprises a length of flexible line.

9. The game apparatus according to claim 7, wherein said flexible line is about twenty feet long, thereby approximating the width of a standard enclosed racquetball court.

10. The game apparatus of claim 7, wherein said tether cord is about twelve feet long in relaxed condition and comprises elastomeric material.

11. The game apparatus of claim 7, wherein said base is portable but sufficiently weighty to remain stationary during movement of said tether cord and ball upon play.

12. The game apparatus of claim 7, wherein the other end of said tether cord is looped through said loop, turned back and secured to itself.

* * * * *

UNITED STATES PATENT AND TRADEMARK OFFICE

CERTIFICATE OF CORRECTION

PATENT NO. : 4,270,757
DATED : June 2, 1981
INVENTOR(S) : Samuel B. Ligon

It is certified that error appears in the above-identified patent and that said Letters Patent are hereby corrected as shown below:

Col. 3, line 16, "An" should be --As--.
Col. 6, line 12, "game or" should be --game for--;
line 17, "an" should be --and--.

Signed and Sealed this

*Fifteenth* Day of *December 1981*

[SEAL]

*Attest:*

GERALD J. MOSSINGHOFF

*Attesting Officer*

*Commissioner of Patents and Trademarks*